US011608990B2

(12) United States Patent
Greipel et al.

(10) Patent No.: US 11,608,990 B2
(45) Date of Patent: Mar. 21, 2023

(54) COOKING DEVICE

(71) Applicant: BSH Hausgeräte GmbH, Munich (DE)

(72) Inventors: Fabian Greipel, Traunstein (DE); Hans Lappat, Garching a.d. Alz (DE); Harald Pfersch, Freilassing (DE); Marco Pietsch, Palling (DE); Klemens Roch, Trostberg (DE); Jesus Vicente Tena Sanchez, Chieming (DE); Helmut Uglorz, Trostberg (DE)

(73) Assignee: BSH Hausgeräte GmbH, Munich (DE)

( * ) Notice: Subject to any disclaimer, the term of this patent is extended or adjusted under 35 U.S.C. 154(b) by 134 days.

(21) Appl. No.: 17/056,435

(22) PCT Filed: May 24, 2019

(86) PCT No.: PCT/EP2019/063427

§ 371 (c)(1),
(2) Date: Nov. 18, 2020

(87) PCT Pub. No.: WO2019/238387

PCT Pub. Date: Dec. 19, 2019

(65) Prior Publication Data

US 2021/0190323 A1 Jun. 24, 2021

(30) Foreign Application Priority Data

Jun. 14, 2018 (DE) ..... 10 2018 209 581.7

(51) Int. Cl.
*F24C 15/00* (2006.01)
*F24C 15/20* (2006.01)

(52) U.S. Cl.
CPC ..... *F24C 15/006* (2013.01); *F24C 15/2007* (2013.01)

(58) Field of Classification Search
None
See application file for complete search history.

(56) References Cited

U.S. PATENT DOCUMENTS

2004/0159317 A1* 8/2004 Walther ..... F24C 15/2007 126/198
2007/0163567 A1* 7/2007 Kaneko ..... F24C 15/327 126/21 A
2020/0405479 A1* 12/2020 Scruggs ..... A61M 60/122

FOREIGN PATENT DOCUMENTS

DE 2305025 A1 8/1974
DE 7606219 U1 8/1976
(Continued)

OTHER PUBLICATIONS

National Search Report DE 102018209581 dated Jan. 29, 2019.
International Search Report PCT/EP2019/063427 dated Jul. 22, 2019.

*Primary Examiner* — Jason Lau
(74) *Attorney, Agent, or Firm* — Michael E. Tschupp; Andre Pallapies; Brandon G. Braun

(57) ABSTRACT

A cooking device includes a cooking chamber wall delimiting at least partially a cooking chamber for receiving food to be cooked. A fan generates a cooling air flow for cooling an outer side of the cooking chamber wall such as to produce an intake region, in which there is a negative pressure in relation to a surrounding area, and a blow-out region, in which there is an excess pressure in relation to the surrounding area. A short-circuit device generates a short-circuit air flow between the blow-out region and the intake region, thereby generating a pressure-neutral region. The cooking chamber wall has a vapor outlet in communication with the cooking chamber for discharging vapor from the cooking chamber into the pressure-neutral region.

15 Claims, 4 Drawing Sheets

(56) References Cited

FOREIGN PATENT DOCUMENTS

| | | | |
|---|---|---|---|
| DE | 10341076 | A1 | 3/2005 |
| EP | 0319673 | A1 | 6/1989 |
| EP | 2279682 | A1 | 2/2011 |
| EP | 2474787 | A2 | 7/2012 |
| EP | 3184909 | A2 | 6/2017 |
| KR | 200349536 | Y1 | 5/2004 |
| WO | 2011080097 | A2 | 7/2011 |
| WO | 2011080100 | A2 | 7/2011 |

* cited by examiner

COOKING DEVICE

CROSS-REFERENCES TO RELATED APPLICATIONS

This application is the U.S. National Stage of International Application No. PCT/EP2019/063427, filed May 24, 2019, which designated the United States and has been published as International Publication No. WO 2019/238387 A1 and which claims the priority of German Patent Application, Serial No. 10 2018 209 581.7, filed Jun. 14, 2018, pursuant to 35 U.S.C. 119(a)-(d).

BACKGROUND OF THE INVENTION

The present invention relates to a cooking device.

Cooking devices, such as ovens or steamers, have a cooking chamber for receiving food to be cooked. One generally known requirement consists in adjusting the humidity in the cooking chamber.

Steam is the cause of the humidity. This is produced during the cooking process and escapes out of the food to be cooked. Furthermore, specific cooking devices, such as steamers, for instance, additionally supply steam for the cooking process.

The requirement of being able to adjust the humidity in the cooking chamber is based on different reasons. The humidity firstly influences the energy consumption. The more humid, in other words the less fresh air is supplied into the cooking chamber, the lower therefore the energy consumption. On the other hand, an excessively high humidity can have a negative impact on the service life of the cooking device.

Various approaches for adjusting the humidity in the cooking chamber have therefore become known. It is common to these approaches to discharge the escaping vapors with the humidity in a controlled manner from the cooking chamber. For instance, WO 2011/080097 A2 describes a two-channel air shaft. A cooling air flow generated by a fan can be controlled with the aid of a flap so that it either flows through a first or through a second channel of the two-channel air shaft. The vapor is supplied exclusively to the second channel by way of an outlet line. If the humidity in the cooking chamber which is detected with a temperature sensor lies below a threshold value, the flap is set so that it does not allow air to flow through the second channel. Accordingly, the ambient pressure in which the vapor escapes prevails in the second channel. The cooling air flow flows exclusively through the first channel. If the humidity in the cooking chamber now exceeds the threshold value, the flap is set so that from now on the cooling air flow only flows through the second channel and no longer through the first channel. Passing the cooling air flow over the outlet in the second channel causes a negative pressure, which actively draws the vapor out of the cooking chamber and thus accelerates the release of humidity to the surrounding area.

WO 2011/080100 A2 follows a similar approach. This provides that the outlet discharging the vapor from the cooking chamber is guided into a chamber which is at least partially decoupled from the ventilation system for pressure purposes. To this end the chamber is only coupled with the ventilation system via relatively small openings.

BRIEF SUMMARY OF THE INVENTION

It is therefore an object of the present invention to provide an improved cooking device. Accordingly, provision is made for a cooking device with a cooking chamber for receiving food to be cooked, which is at least partially delimited by a cooking chamber wall, a fan for generating a cooling air flow for cooling an outer side of the cooking chamber wall with the result that an intake region, in which there is a negative pressure in relation to the surrounding area, and a blow-out region, in which there is excess pressure in relation to the surrounding area, is produced, and for a short-circuit device for generating a short-circuit air flow between the blow-out and intake region and in this way generating a pressure-neutral region, and a vapor outlet in the cooking chamber wall for discharging vapors from the cooking chamber into the pressure-neutral region.

With the aid of the short-circuit device, the pressure-neutral region can be easily created, in particular independently of additional actuators. At the same time, on account of this approach there is the possibility of linking the pressure-neutral devaporization to the pressurized ventilation system and cooling the vapor down by mixing it with the general device cooling air and discharging them together. Furthermore, since the pressure-neutral region does not force devaporization, a large cross-section can be selected for the transition from the cooking chamber to the pressurized part of the ventilation system. This large cross-section also enables large quantities of vapor to escape freely. With operations with less vapor, only the accruing vapors are likewise discharged without forcing the delivery of fresh air.

According to one embodiment the cooking device has a separating wall structure, which separates the pressure-neutral region from the blow-out and intake region for pressure purposes.

The separating wall structure can have one or more separating walls, for instance. The separating wall structure or the one or more separating walls can be manufactured from sheet metal, for instance. In particular, a two-channel ventilation system can be provided, wherein the first channel forms the intake region and the second channel the blow-out region. The vapor outlet can in particular open into the first channel. The separating wall structure can have in particular a separating wall, which separates the first channel from the second channel. In addition or alternatively the separating wall structure can have a separating wall, which at least partially surrounds the vapor outlet on the outer side of the cooking chamber wall. This separating wall can be attached in a pressure tight manner to the outer side of the cooking chamber wall and/or in a pressure tight manner to the separating wall between the first and second channel.

According to a further embodiment, a volume enclosed by the separating wall structure is embodied to be open toward the intake region.

The correspondingly provided opening allows vapor to flow from the vapor outlet via the pressure-neutral region and the outer side of the cooking chamber wall into the intake region. The intake region can however not extend into the pressure-neutral region by means of the opening. This can be achieved in particular by the short-circuit air flow neutralizing the corresponding intake effect. The short-circuit air flow between the pressure-neutral region and the intake region is preferably introduced in particular via an equalization opening in the separating wall structure.

According to a further embodiment, the short-circuit device has an equalization opening which is embodied and designed in the separating wall structure for the short-circuit current to flow therethrough.

The equalization opening can in particular be embodied as a passage or hole in the separating wall structure, in particular in a separating wall of the same. The short-circuit air flow flows through the equalization opening from the blow-out region into the intake region.

According to a further embodiment, the separating wall structure has a U shape.

A "U shape" is understood here to mean any U shape, V shape, semicircular shape, tub shape or such like. The corresponding opening of the U is preferably directed in the flow direction toward the fan. Moreover, the equalization opening can lie in the region of the opening. The U can be formed in particular by the afore-described separating wall which extends about the vapor outlet. The U-shaped separating wall therefore surrounds the pressure-neutral region at least in sections on its inner side, while on its outer side it is surrounded by the intake region.

According to a further embodiment, the short-circuit device is designed to adjust a volume flow of the short-circuit current.

"Adjusting the volume flow" is understood here to mean adjusting, in other words changing, the volume flow with respect to its strength, (for instance in liters/minutes) and/or direction. This makes it possible to set the pressure at the vapor outlet. In this case, the pressure-neutral region provided in a first operating mode of the cooking device is provided in a second operating mode of the cooking device with a negative pressure in relation to the surrounding area, in order to allow the vapor to escape more quickly, particularly in the case of high humidity in the cooking chamber. Similarly, in this way an excess pressure in relation to the surrounding area can be provided at the vapor outlet for instance in the second operating mode or in a third operating mode of the cooking device. This is particularly the case if a humidity in the cooking chamber is too low. The cooking device can have a humidity sensor, in particular in the cooking chamber, which detects the humidity in the cooking chamber or the humidity of the vapor. The short-circuit device can be designed to set the volume flow of the short-circuit flow as a function of the humidity detected with the aid of the sensor.

According to a further embodiment, the short-circuit device has a blocking device for partially or completely blocking the equalization opening.

The blocking device can be embodied as a flap or slider, for instance. The flap can be provided pivotably, for instance, in order to adjust the cross-section of the equalization opening. The slider can be provided in a linearly displaceable manner, for instance, in order to adjust the cross-section of the equalization opening.

According to a further embodiment, the short-circuit device has one or more air guide elements for guiding the short-circuit air flow.

As a result, an effective pressure equalization can take place between the blow-out region and the intake region, so that the pressure-neutral region can be formed reliably.

According to a further embodiment, a first air guide element is provided, which is directed against an air flow in the blow-out region.

The first air guide element thus guides the air flow in the blow-out region into the equalization opening.

According to a further embodiment, a second air guide element is provided, which is designed to guide the short-circuit flow to the fan.

The second air guide element therefore effectively guides the air flow back to the fan after passing the equalization opening. It should be noted that only the second air guide element and not the first air guide element, and vice versa, can be provided. Accordingly, the second air guide element can also be referred to as "air guide element" or as "first air guide element". Similarly, the first air guide element can be referred to as "air guide element" or "second air guide element".

According to a further embodiment, the one or more air guide elements are embodied as lugs.

The lugs can be easily manufactured from metal, for instance. These can be produced in particular by partial punching and bending out.

According to a further embodiment, the first and second air guide element together with an edge structure delimiting the equalization opening form a Y shape.

The Y shape is particularly suited to guiding the air flow in the blow-out region via the intake region back toward the fan.

According to a further embodiment, an orientation of the one or more air guide elements can be adjusted with respect to a plane, in which the equalization opening lies.

The orientation can be adjusted automatically or manually. Accordingly, the orientation can take place on, for instance, the respectively installed fan or the current operating mode of the fan (in particular adjusted to a negative pressure currently generated hereby).

According to a further embodiment, the vapor outlet is arranged within the U shape, in particular centrally herein.

Favorable flow ratios result herefrom.

According to a further embodiment, the equalization opening is arranged offset with respect to an axis of symmetry of the U shape.

This can advantageously achieve a vortex buildup. In particular, it is therefore possible for air to be guided out from the blow-out region via the equalization opening on one side into the U and accordingly for a half-ring-shaped flow to be generated along the inner wall of the U shape. In particular, a mixing of the vapor can therefore also be achieved with the (cooling) air flowing in the U shape.

BRIEF DESCRIPTION OF THE DRAWINGS

Further advantageous embodiments and aspects of the cooking device are the subject matter of the subclaims and the exemplary embodiments of the cooking device described below. Furthermore, the cooking device is explained in more detail with the aid of preferred embodiments with reference to the appended figures.

DETAILED DESCRIPTION OF EXEMPLARY EMBODIMENTS OF THE PRESENT INVENTION

Figure 1:
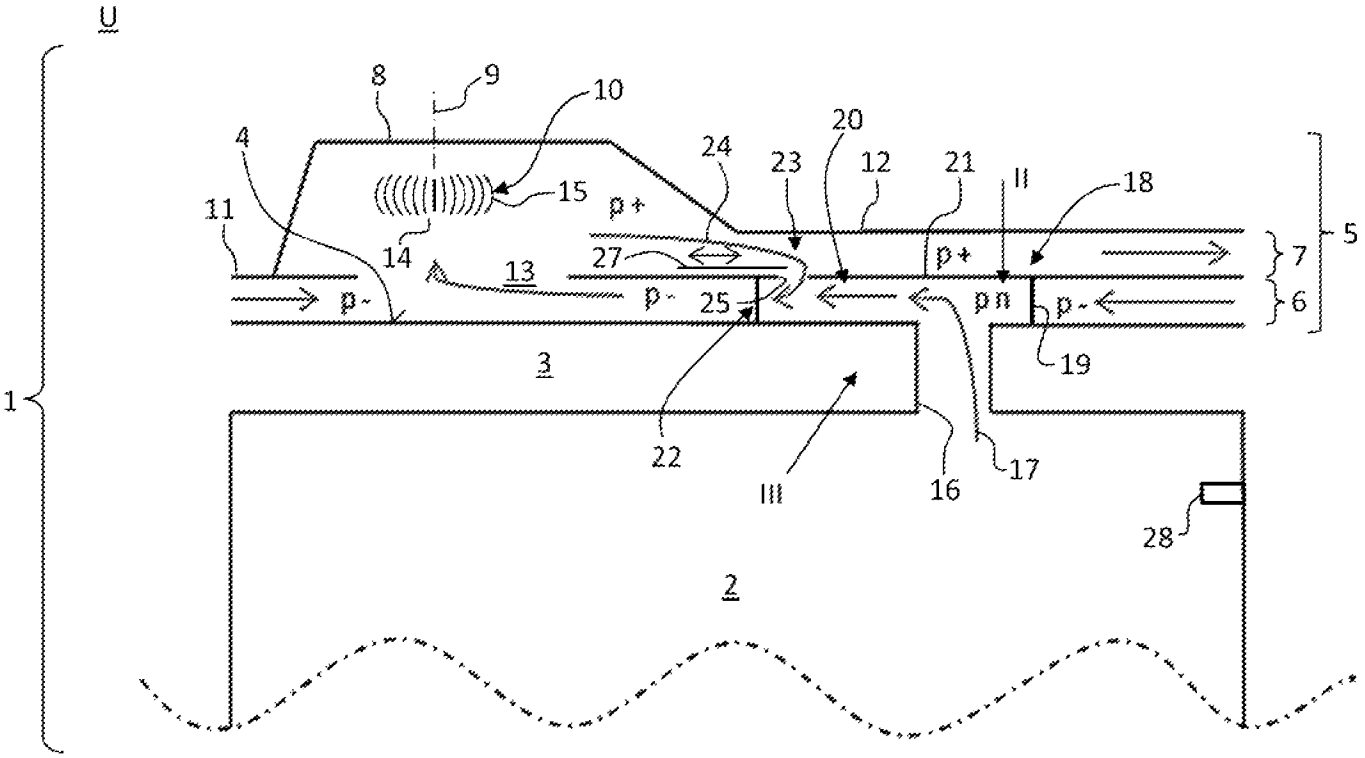
FIG. 1 shows a schematic representation of a section of a cooking device according to one embodiment.

The same reference characters in the figures refer to identical or functionally identical components, unless specified otherwise.

FIG. 1 shows a cooking device 1 in a schematic view. The cooking device 1 can be embodied as an oven or steamer, for instance.

The cooking device 1 comprises a cooking chamber 2 for receiving food to be cooked (not shown). The cooking chamber 1 is delimited by a cooking chamber wall 3. Part of the cooking chamber wall is generally a door (not shown). The cooking chamber can be loaded with the food to be cooked by way of the door.

During cooking operation of the cooking device 1, the cooking chamber 2 is heated by means of heating elements (not shown). Here the cooking chamber wall 3 is sometimes hot and must be cooled. In addition to the cooking chamber wall 3, it may also be necessary to cool an electric controller, for instance in the form of a control board (not shown), of the cooking chamber 1.

For the purpose of cooling the cooking chamber wall 3 (and/or the control board), a two-channel ventilation system 5 is arranged on its outer side 4. The two-channel ventilation system 5 comprises a (first) channel 6, a (second) channel 7 and a fan housing 8. In the fan housing 8 a fan 10, which can be driven about an axis of rotation 9 with aid of an electric motor (not shown), is provided, in the exemplary embodiment in the form of a radial fan. The channel 6 and the channel 7 are separated by means of a separating wall 11, which extends at least in sections parallel to the outer side 4 of the cooking chamber wall 3. Here the separating wall 11 together with the cooking chamber wall 3 forms the first channel 6.

Furthermore, a separating wall 12 is provided. This forms the second channel 7 together with the separating wall 11.

An opening 13 is embodied in the separating wall 11 and opposes an axial intake side 14 of the radial fan 10 in the region of its axis of rotation 9. The channel 6 is therefore connected in an air-conducting manner with the axial intake side 14 of the radial fan 10. In contrast a radial blow-out side 15 of the radial fan 10 is connected in an air-conducting manner with the channel 7.

Furthermore, the cooking chamber wall 3 is provided with a circular hole, for instance, which forms a vapor outlet 16. Vapor can escape from the cooking chamber 2 into the channel 6 through the vapor outlet 16.

Figure 2:
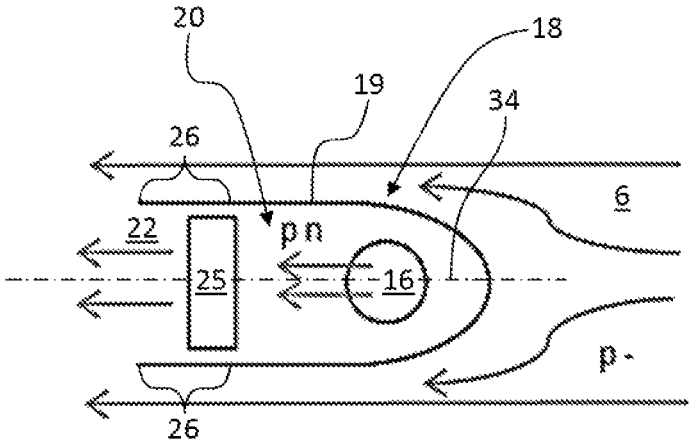
FIG. 2 shows a view II from FIG. 1.

FIG. 2 shows a view II from FIG. 1. This illustrates, in conjunction with FIG. 1, a separating wall structure 18 of the cooking device 1, which partially surrounds the vapor outlet 16. The separating wall structure 18 comprises a (first) separating wall, which is embodied in particular to be U-shaped. The U shape 19 can be seen in FIG. 2. The U shape 19 or the volume 20 enclosed by this is embodied to be closed with the aid of a (second) separating wall facing the cooking chamber wall 3. In the exemplary embodiment, the second separating wall is formed by a segment 21 of the separating wall 11. Here the U shape 19 is connected in a sealing manner with the cooking chamber wall 3 on the one hand (in the exemplary embodiment according to FIG. 1 below) and on the other hand in a sealing manner with the segment 21 (in the exemplary embodiment according to FIG. 1 above). The U shape 19 is provided with an opening 22. The opening 22 is directed toward the radial fan 10.

Furthermore, the cooking device 1 has a short-circuit device 23. This is designed to generate a short-circuit air flow 24, as explained in further detail below. To this end the short-circuit device 23 has an equalization opening 25, which is formed as a passage in the segment 21 of the separating wall 11 and thus connects the channel 6 to the channel 7 in an air-conducting manner. The equalization opening 25 can be provided immediately adjacent to the opening 22 of the U shape 19. In the exemplary embodiment, the equalization opening 25 is provided so that it opens into a part of the volume 20 to which end segments 26 the U shape 19 is assigned. Here FIG. 2 only shows the equalization opening 26, but not the segment 21 of the separating wall 11.

The pressure ratios in the cooking device 1 and in particular the function of the short-circuit air flow 24 are explained below. In the figures, to this end an intake region is referred to with p−, a blow-out region with p+ and a pressure-neutral region with pn. Furthermore, flow directions of the air are indicated in the figures with arrows.

A negative pressure prevails in the intake region p− in relation to the surrounding area U, whereas an excess pressure by contrast prevails in the blow-out region p+. In the pressure-neutral region pn the pressure corresponds to the surrounding pressure.

The negative pressure and the excess pressure result on account of the activity of the radial fan 10, which moves air out of the channel 6 into the channel 7. The air flow developing accordingly in the channel 6 flows past the outer wall 4 of the cooking chamber 3 and possibly past electronic components (not shown) of the cooking device 1 and therefore cools these.

The negative pressure in the intake region p− would intrinsically result in the vapor 17 being sucked out of the vapor outlet 16. This is prevented, however, at least in a first operating mode of the cooking device 1, by the short-circuit device 23 permitting the short-circuit air flow 24. This provides for a pressure equalization between the blow-out region p+ and the intake region p− in the region of the equalization opening 25. Accordingly, the equalization opening 25 provides for a local decoupling of the pressure in the volume 20 enclosed by the separating wall structure 18. Incidentally, the separating wall structure 18 itself also provides for a decoupling from the negative pressure surrounding the U shape 19 (see FIG. 2) on the outside and the excess pressure surrounding the segment 21 (see FIG. 1) for pressure purposes. Accordingly, a pressure-neutral region pn results in the region of the vapor outlet 16. This means that vapor 17 can escape unhindered from the cooking chamber 2, it is therefore neither drawn out nor driven back. This corresponds to a situation in which the vapor 17 is released directly into the surrounding area. At the same time, the present construction ensures however that after leaving the volume 20 via the opening 22 of the U shape 19, the vapor 17 mixes with the cooling air flowing through the channel 6, is guided via the opening 13 toward the radial fan 10 and is released into the surrounding area U from here via the second channel 7. Accordingly, on account of the mixing with the cooling air, the vapor 17 has a temperature which is harmless to furniture (not shown) adjoining the cooking device 1 and also to people who remain in the vicinity of the cooking device 1.

It should be noted that with this preferred construction the vapor outlet 16 has the smallest cross-section, which the vapor 17 has to overcome on its way to the surrounding area U.

In a further embodiment, the short-circuit device 23 can have a slider 27 and possibly a humidity sensor 28. The humidity sensor 28 can be arranged in the cooking chamber 2. The humidity sensor 28 is designed to detect a humidity in the cooking chamber 2. The slider 27 is designed to be displaced linearly for instance, in order as a result to close the equalization opening 25 optionally partially or completely. In other embodiments, the slider 27 can be provided so that it does not permit intermediate positions (for instance half open) but instead permits only a completely closed and a completely open equalization opening 25.

As a result of the partial or complete closure of the equalization opening 25, the pressure in the region of the equalization opening 16 can be modified in a second operating mode of the cooking device 1 so that there either an excess pressure or a negative pressure (instead of the pressure neutrality in the first operating mode) prevails. If a negative pressure is produced, this speeds up a discharge of the vapor 17 from the cooking chamber 2. Conversely, an excess pressure results in the vapor 27 accumulating in the cooking chamber 2.

If the humidity sensor 28 is provided, the slider 27 can therefore be controlled as a function of the detected moisture. There is therefore the possibility of providing a control loop which controls the slider 27 automatically and thus adjusts the cross-section of the equalization opening 25 and as a result the pressure prevailing at the vapor outlet 16.

Figure 3:
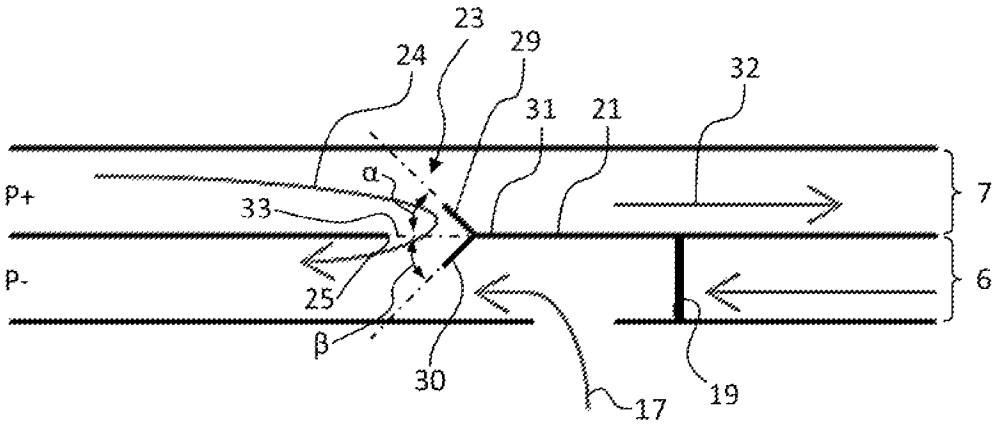
FIG. 3 shows a subregion III from FIG. 1 according to a further embodiment.

FIG. 3 shows a view III from FIG. 1 according to a further embodiment. In this the short-circuit device 23 has a (first) air guide element 29 and a (second) air guide element 30. In the exemplary embodiment the air guide elements 29, 30 are embodied as lugs. Furthermore, the lugs 29, 30, as shown in the exemplary embodiment according to FIG. 3, can be molded to an edge 31 of the segment 21 of the separating wall 11 which delimits the equalization opening 25. The lugs 29, 30 and the edge 31 here form a Y shape. This results in the lug 29 being directed against an air flow 32, which the radial fan 10 generates in the channel 7. This results in the short-circuit air flow 24 being deflected into the equalization opening 25. The alignment of the lug 30 causes the short-circuit air flow 24 to be guided back to the radial fan 10 through the channel 6. This advantageously results in the radial fan 10 uniformly passing air past the lug 29 in the blow-out region p+.

Provision can be made in embodiments for an angle a, which the lug 29 forms with the plane 33 of the equalization opening 25, to be adjustable. In addition or alternatively, provision can be made for an angle β, which the lug 30 forms with the plane 33 of the equalization opening 24, to be adjustable. The angles a and 13 have a significant influence on the devaporization. The smaller the angle β, the stronger the extraction. The larger the angle β, the weaker the extraction system. Here "extraction system" is understood to mean that the pressure at the vapor outlet 16 is changed from pressure-neutral to a negative pressure. If the angle β exceeds a specific limit angle, this results in the short-circuit air flow 24 being guided partially into the cooking chamber 2 via the vapor outlet 16. The angles α and β preferably amount in each case to between 60 and 85°. In this way a particularly favorable pressure can be produced at the vapor outlet 16.

The orientation of the lugs 29, 30 can be adjusted manually, by way of actuators or automatically. For instance, an electromagnet or electric motor can be provided as an actuator.

Figure 4:
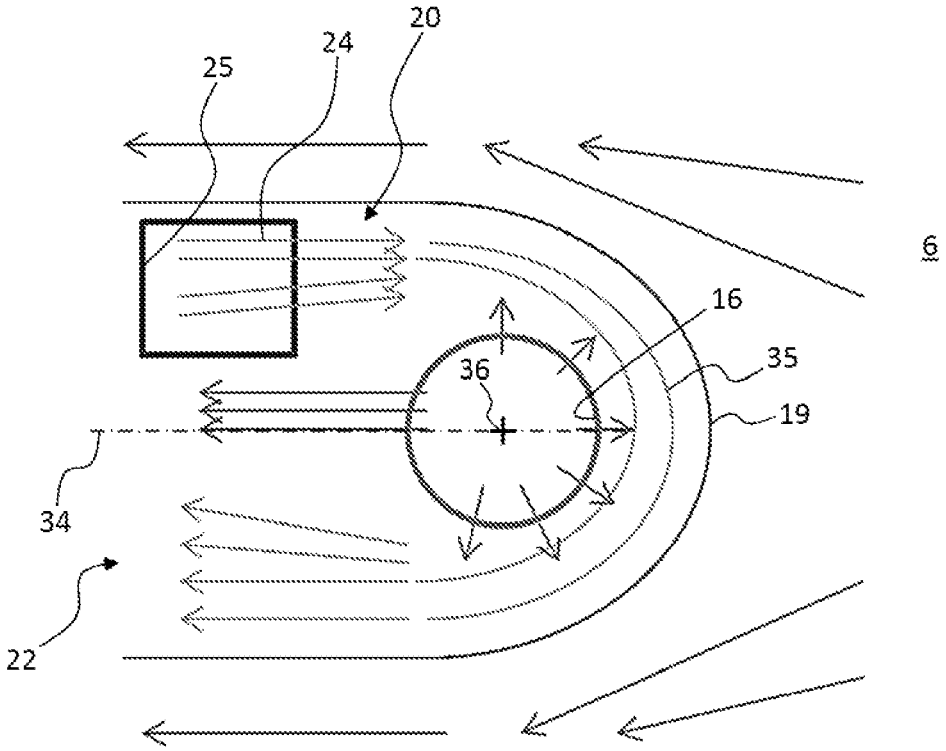
FIG. 4 shows the view from FIG. 2, however according to yet another embodiment.

FIG. 4 shows the view from FIG. 2, but according to yet another embodiment. In the embodiment according to FIG. 2, the vapor outlet 16, which is embodied as a circular hole, is arranged with its center point 36 on an axis of symmetry 34. The axis of symmetry 34 is the axis of symmetry of the U shape 19 in a view at right angles to the outer side 4 of the housing wall 3. On this axis of symmetry 34, in the exemplary embodiment according to FIG. 2, the equalization opening 25 which is configured to be rectangular for instance is arranged centrally. Accordingly, the axis of symmetry 34 is also an axis of symmetry of the vapor outlet 16 and the equalization opening 25. Contrary hereto, the equalization opening 25 in the exemplary embodiment according to FIG. 4 is embodied offset in relation to the axis of symmetry 34. This is so that the equalization opening 25 is formed exclusively to one side of the axis of symmetry 34 (in the exemplary embodiment according to FIG. 4 the topside). This construction results in the short-circuit air flow 24 being guided on one side into the U shape 19, wherein a half-ring-shaped flow 35 is produced along the inner wall of the U shape 19. As a result, the pressure in the region of the vapor outlet 16 is influenced. In particular, the vapor volume flow can be adjusted as a result. Moreover, it is achieved that on account of vortex buildup the vapor 17 discharged from the vapor outlet 16 mixes with the flow 35, is cooled as a result and escapes via the opening 22 into the channel 6. In the exemplary embodiment according to FIG. 4, too, the flow 35 can be adjusted so that the pressure neutrality described in conjunction with FIGS. 1 and 2 exists at the vapor outlet 16.

Although the present invention has been described with the aid of preferred exemplary embodiments, it can be modified in a variety of ways.

The invention claimed is:

1. A cooking device, comprising:

a cooking chamber wall delimiting at least partially a cooking chamber for receiving food to be cooked, a fan generating a cooling air flow for cooling an outer side of the cooking chamber wall such as to produce an intake region, in which there is a negative pressure in relation to a surrounding area, and a blow-out region, in which there is an excess pressure in relation to the surrounding area;

a short-circuit device configured to generate a short-circuit air flow between the blow-out region and the intake region, thereby generating a pressure-neutral region, said cooking chamber wall having a vapor outlet in communication with the cooking chamber for discharging vapor from the cooking chamber into the pressure-neutral region; and a separating wall structure separating the pressure-neutral region from the blow-out and intake regions for pressure purposes.

2. The cooking device of claim 1, wherein the separating wall structure encloses a volume which opens out to the intake region.

3. The cooking device of claim 1, wherein the short-circuit device has an equalization opening, which is formed in the separating wall structure for passage of the short-circuit air flow.

4. The cooking device of claim 1, wherein the separating wall structure has a U shaped configuration.

5. The cooking device of claim 1, wherein the short-circuit device is configured to adjust a volume flow of the short-circuit air flow.

6. The cooking device of claim 3, wherein the short-circuit device includes a blocking device configured to partially or completely block the equalization opening.

7. The cooking device of claim 1, wherein the short-circuit device includes an air guide element for guiding the short-circuit air flow.

8. The cooking device of claim 7, wherein the air guide element is directed against an air flow in the blow-out region.

9. The cooking device of claim 7, wherein the air guide element is configured to guide the short-circuit air flow to the fan.

10. The cooking device of claim 7, wherein the air guide element is embodied as a lug.

11. The cooking device of claim 3, wherein the short-circuit device includes a first air guide element directed against an air flow in the blow-out region and a second air guide element configured to guide the short-circuit air flow to the fan, said first and second air guide elements forming a Y shape together with an edge structure which delimits the equalization opening.

12. The cooking device of claim 3, wherein the short-circuit device includes an air guide element for guiding the short-circuit air flow, said air guide element having an orientation which is adjustable in relation to a plane, in which the equalization opening lies.

13. The cooking device of claim 4, wherein the vapor outlet is arranged within the U shaped separating wall structure.

14. The cooking device of claim 4, wherein the vapor outlet is arranged centrally within the U shaped separating wall structure.

15. The cooking device of claim 3, wherein the separating wall structure has a U shaped configuration, said equalization opening being arranged offset with respect to an axis of symmetry of the U shaped separating wall structure.

* * * * *